US008794745B2

(12) United States Patent
Yamane et al.

(10) Patent No.: US 8,794,745 B2
(45) Date of Patent: Aug. 5, 2014

(54) LIQUID EJECTION HEAD AND LIQUID EJECTION METHOD

(75) Inventors: Toru Yamane, Yokohama (JP); Tomoyuki Inoue, Tokyo (JP); Eisuke Nishitani, Tokyo (JP); Kenji Yabe, Yokohama (JP); Atsushi Sakamoto, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 54 days.

(21) Appl. No.: 13/357,857

(22) Filed: Jan. 25, 2012

(65) Prior Publication Data

US 2012/0200641 A1 Aug. 9, 2012

(30) Foreign Application Priority Data

Feb. 9, 2011 (JP) ..... 2011-026104

(51) Int. Cl.
*B41J 2/05* (2006.01)

(52) U.S. Cl.
USPC ..... 347/65

(58) Field of Classification Search
USPC ..... 347/65
See application file for complete search history.

(56) References Cited

U.S. PATENT DOCUMENTS

| | | | | |
|---|---|---|---|---|
| 5,218,376 | A | 6/1993 | Asai | |
| 5,916,452 | A | 6/1999 | Kobayashi et al. | |
| 6,155,673 | A | 12/2000 | Nakajima et al. | |
| 6,652,079 | B2 | 11/2003 | Tsuchii et al. | |
| 6,761,435 | B1 * | 7/2004 | Powers | 347/65 |
| 6,984,025 | B2 | 1/2006 | Kaneko et al. | |
| 6,988,786 | B2 | 1/2006 | Kaneko et al. | |
| 7,152,951 | B2 | 12/2006 | Maher et al. | |
| 7,172,264 | B2 | 2/2007 | Kaneko et al. | |
| 7,527,352 | B2 | 5/2009 | Kaneko et al. | |
| 7,771,026 | B2 | 8/2010 | Ide et al. | |
| 7,963,635 | B2 | 6/2011 | Oikawa et al. | |
| 8,087,759 | B2 | 1/2012 | Oikawa et al. | |
| 8,096,644 | B2 | 1/2012 | Murakami et al. | |
| 2008/0231664 | A1 * | 9/2008 | Murakami et al. | 347/56 |
| 2009/0315945 | A1 * | 12/2009 | Oikawa et al. | 347/44 |
| 2011/0292132 | A1 * | 12/2011 | Nagatsuka | 347/65 |

FOREIGN PATENT DOCUMENTS

| | | | |
|---|---|---|---|
| CN | 1863678 | A | 11/2006 |
| JP | 4-10940 | A | 1/1992 |
| JP | 4-10941 | A | 1/1992 |
| JP | 2008-238401 | A | 10/2008 |

OTHER PUBLICATIONS

Office Action in Chinese Patent Application No. 201210028909.9, dated Feb. 8, 2014.

* cited by examiner

*Primary Examiner* — Lisa M Solomon
(74) *Attorney, Agent, or Firm* — Fitzpatrick, Cella, Harper & Scinto

(57) ABSTRACT

A liquid ejection method is effected in a liquid ejection head that includes an ejection orifice for ejecting a liquid, a flow path for supplying the liquid from a liquid supply port to the ejection orifice, and a heat generating element. The heat generating element is rectangular with a long-side to short-side ratio of 2.5 or more for generating thermal energy used to eject the liquid, and a longitudinal direction of the heat generating element is arranged along an extending direction of the flow path. An end portion of the heat generating element on a downstream side with respect to a liquid flowing direction within the flow path is located between an end portion of the ejection orifice on the downstream side and an end portion of the ejection orifice on an upstream side when viewed from a direction in which the liquid is ejected from the ejection orifice.

4 Claims, 10 Drawing Sheets

5
10
12
15
17.2
20
22.5
25
0
+5
+10
+12
+15
+17.2
+20
+22.5
+25

LIQUID EJECTION HEAD AND LIQUID EJECTION METHOD

BACKGROUND OF THE INVENTION

1. Field of the Invention

The present invention relates to a liquid ejection head for ejecting a liquid, and particularly to an ink jet head from which an ink is ejected to conduct recording on a recording medium, and a liquid ejection method.

2. Description of the Related Art

A method in which a heat generating element is used to eject an ink is widely used as a liquid ejection method for an ink jet recording apparatus. This method is such a method that thermal energy is generated by a heat generating element arranged in a flow path (nozzle) to which an ink is supplied, thereby causing film-boiling of the ink around the heat generating element to generate a bubble and applying kinetic energy to the ink by the bubbling pressure to eject the ink toward a recording medium from an ejection orifice. This method involves a problem that the heat generating element is damaged by cavitation caused by the extinction of the bubble generated on the heat generating element.

U.S. Pat. No. 7,152,951 discloses a liquid ejection head and a liquid ejection method by which damage to the heat generating element caused by the cavitation can be inhibited. In this liquid ejection head, an ejection orifice is arranged in opposition to the surface of the heat generating element with a center of the ejection orifice deviated from a center of the heat generating element toward the upstream side or the downstream side of the ink flowing direction. A bubble thereby communicates with the air at a site where the bubble is hard to be divided upon ejection of a droplet, so that the bubble is inhibited from being divided into a portion of the upstream side and a portion of the downstream side in the ink flowing direction. As a result, the bubble can be prevented from being divided to remain in a flow path, and so cavitation that generally easily occurs on the downstream side in the ink flowing direction and damage to the heat generating element attending thereon can be inhibited. This technique is particularly effective in a liquid ejection head having a heat generating element of nearly a square with an aspect ratio of about 1.

Japanese Patent Application Laid-Open No. 2008-238401 discloses such a technique that an ejection orifice and a flow path are arranged at a high density of 1,200 dpi (1,200 dots per inch (2.54 cm)) or more from a demand for further densification of ink jet recording. Specifically, in Japanese Patent Application Laid-Open No. 2008-238401, plural ejection orifices and flow paths are arranged in a row at a density of 1,200 dpi.

Japanese Patent Application Laid-Open No. H04-10940 and Japanese Patent Application Laid-Open No. H04-10941 disclose an example of a method of ejecting an ink in an ink jet recording apparatus.

When ejection orifices and flow paths are arranged at a high density of 1,200 dpi or more as disclosed in Japanese Patent Application Laid-Open No. 2008-238401 to attempt to eject a droplet of 1.5 pl or more, the flow path needs to be formed slenderly. Accordingly, a (slender) heat generating element having a large aspect ratio according to the form of the flow path needs to be used unlike the invention described in U.S. Pat. No. 7,152,951. Specifically, the aspect ratio of the heat generating element needs to be controlled to 2.5 or more (a vertical length is 2.5 times or more as much as a horizontal length). As a result, damage to the heat generating element by such cavitation as illustrated in FIG. 12 of U.S. Pat. No. 7,152,951 may occur.

SUMMARY OF THE INVENTION

According to the present invention, there is provided a liquid ejection head comprising an ejection orifice for ejecting a liquid, a flow path for supplying the liquid from a liquid supply port holding the liquid to the ejection orifice; and a heat generating element of a rectangular form with a long-side to short-side ratio of 2.5 or more for generating thermal energy used to eject the liquid, a longitudinal direction of the heat generating element being arranged along an extending direction of the flow path, wherein an end portion of the heat generating element on a downstream side of a liquid flowing direction within the flow path is located between an end portion of the ejection orifice on the downstream side and an end portion of the ejection orifice on an upstream side when viewed from a direction to which the liquid is ejected from the ejection orifice.

According to the present invention, there is also provided a liquid ejection method from a liquid ejection head, comprising providing a liquid ejection head comprising an ejection orifice for ejecting a liquid, a flow path for supplying the liquid from a liquid supply port holding the liquid to the ejection orifice, and a heat generating element of a rectangular form with a long-side to short-side ratio of 2.5 or more for generating thermal energy used to eject the liquid, a longitudinal direction of the heat generating element being arranged along an extending direction of the flow path; and driving the heat generating element to generate a bubble in the liquid, and allowing a meniscus entered in the interior of the flow path from the ejection orifice during contraction of the bubble after the bubble has enlarged to communicate with the bubble on an upstream side of a liquid flowing direction within the flow path with respect to the center of the longitudinal direction of the heat generating element, thereby allowing the bubble to communicate with outside air.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

Figure 1:
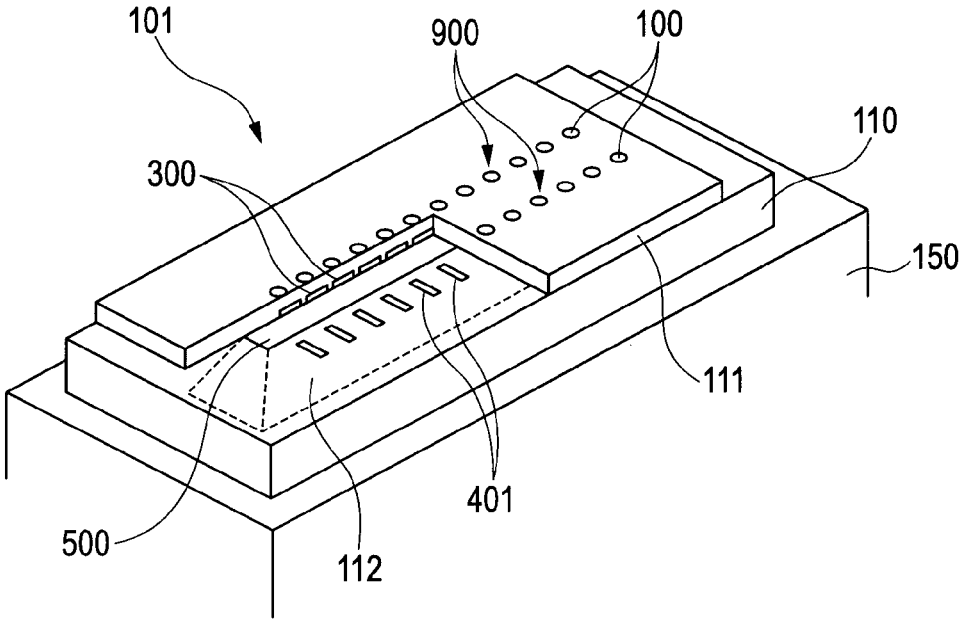
FIG. 1 is a partially cutaway perspective view of a principal part of a liquid ejection head according to an embodiment of the present invention.

The whole construction of an ink jet recording head 101 that is an example of a liquid ejection head according to the present invention is first described. FIG. 1 is a partially cutaway perspective view of a principal part of this ink jet recording head 101. This ink jet recording head 101 is provided with an element substrate 110 on which a plurality of heat generating elements (heaters) 401 are arranged and a flow path forming member 111 that is laminated on and joined to a main surface of this element substrate 110 and forms a plurality of flow paths 300. On the element substrate 110, an ink supply member 150 is joined to a surface opposing the surface to which the flow path forming member 111 is joined.

The element substrate 110 may be formed by, for example, glass, ceramic, resin or metal. However, in particular, it is generally formed by Si. On the main surface of the element substrate 110, a heat generating element 401, an electrode (not illustrated) for applying voltage to the heat generating element 401 and a wiring (not illustrated) connected to this electrode are respectively provided according to a predetermined wiring pattern at every flow path 300. On the main surface of the element substrate 401, an insulating film (not illustrated) for improving divergence of heat is also provided so as to cover the heat generating elements 401. In addition, a protecting film (not illustrated) for protecting the element substrate 110 from cavitation caused upon extinction of a bubble is provided over the main surface of the element substrate 110 so as to cover the insulating film.

The ink supply member 150 has an ink supply port (supply chamber) 500 for supplying an ink that is a liquid to be ejected to the element substrate 110 from an ink tank (not illustrated).

Figure 2:
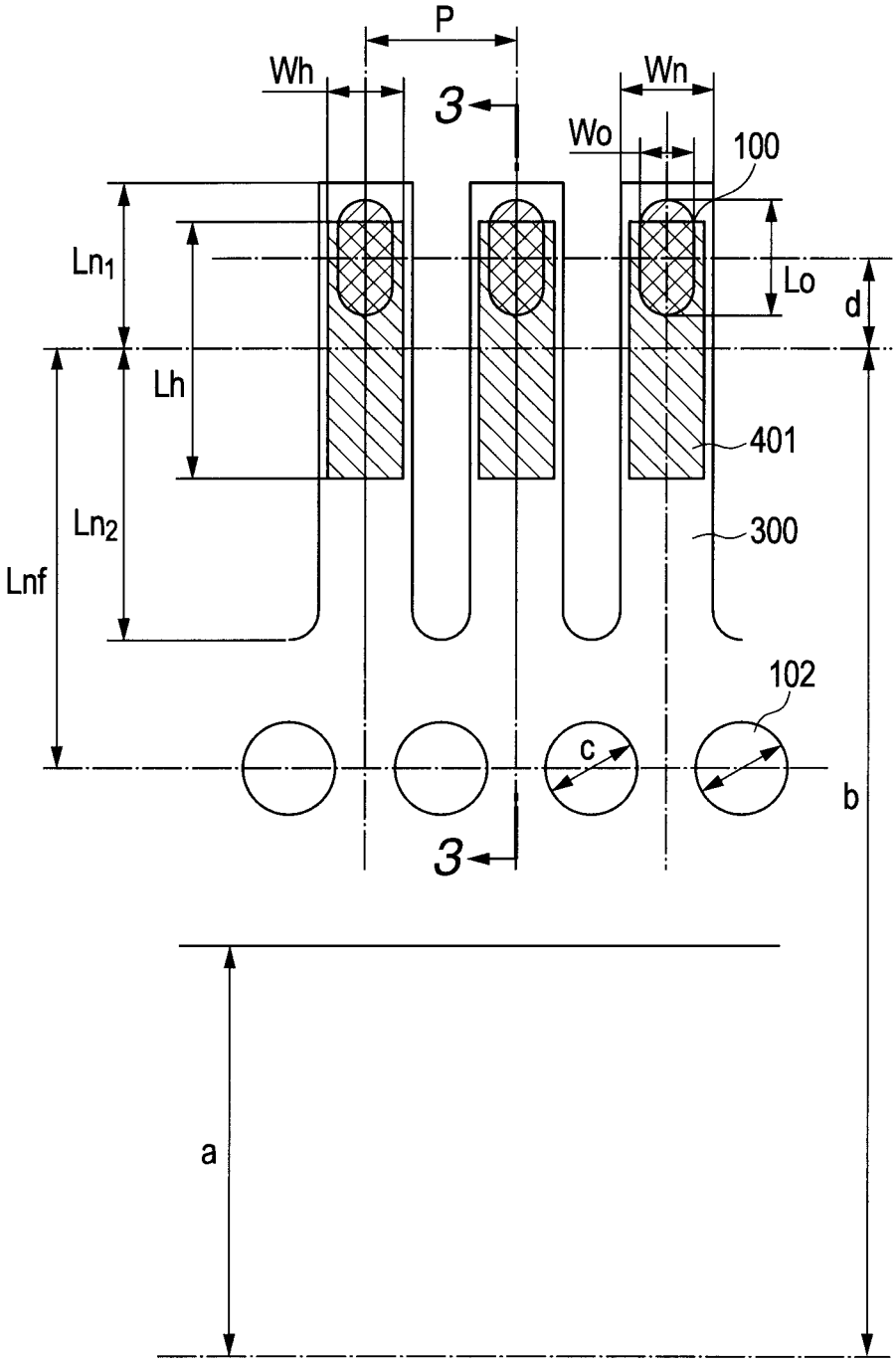
FIG. 2 is an enlarged plan view of a principal part of a liquid ejection head according to a first embodiment of the present invention.

The flow path forming member 111 has a plurality of flow paths (nozzles) 300 to which an ink is supplied, a plurality of ejection orifices 100 each located at the tip of the flow path 300 and opened to the outside and a common liquid chamber 112 linking each flow path 300 to the ink supply port 500 as illustrated in FIG. 2. The ejection orifice 100 is formed at a position almost opposite to the heat generating element 401. The ink flows from the common liquid chamber 112 to the ejection orifice 100 within the flow path 300.

This ink jet recording head 101 has the plural heat generating elements 401 and the plural flow paths 300 on the element substrate 110, and the plural flow paths 300 form a first and a second flow path array 900 opposing each other with the supply chamber 500 sandwiched therebetween. The plural flow paths 300 forming the first flow path array are arranged in such a manner that their longitudinal are arranged in such a manner that their longitudinal directions parallel each other. Likewise, the plural flow paths 300 forming the second flow path array are arranged in such a manner that their longitudinal directions parallel each other. The plural flow paths 300 in each flow path array are formed at a density of 1,200 dpi (1,200 dots per inch (2.54 cm)) or more. Accordingly, the interval between adjoining flow paths 300 in each flow path array 900 is 1/1,200 inch (about 0.021 mm) or less. The respective flow paths 300 in the second flow path array and the respective flow paths 300 in the first flow path array may be arranged zigzag (alternate the respective flow paths 300 in both flow path arrays 900 with each other) in some cases, as needed, for reasons of dot arrangement.

Such an ink jet recording head 101 may be so constructed that a bubble generated upon ejection of an ink communicates with the air through the ejection orifice 100 by performing the ink jet recording method disclosed in, for example, Japanese Patent Application Laid-Open No. H04-10940 or Japanese Patent Application Laid-Open No. H04-10941.

The detailed structure of the ink jet recording head 101 according to the present invention that has such a basic structure will hereinafter be described by specific embodiments.

First Embodiment

The first embodiment of the present invention is described with reference to FIGS. 2 to 6. FIG. 2 is an enlarged plan view illustrating surroundings of a flow path of an ink jet recording head 101 according to this embodiment. The dimensions of respective portions in this embodiment are described below.

The arrangement pitch P between respective flow paths 300 in the first and second flow path arrays 900 of the ink jet recording head 101 according to this embodiment is 21 μm, and a high-density arrangement of 1,200 dpi is realized. As a result, the width Wn of each flow path 300 is 12.8 μm and is very narrow. The ejection amount of a droplet ejected from this flow path 300 through an ejection orifice 100 is 2.8 ng. Therefore, the ejection orifice 100 is 8 μm in width Wo and 16 μm in length Lo in view of a balance between limitation of the width Wn of the flow path 300 and procurement of an available area and is in the form of an ellipse whose aspect ratio is 2.0 (=16/8). However, the plane form of the ejection orifice 100 is not limited to the ellipse and may be oval or rectangular.

The heat generating element 401 is 10.6 μm in width Wh and 34.4 μm in length Lh from the balance between limitation of the width Wn of the flow path 300 and procurement of an available area like the ejection orifice 100 and is in the form of a slender rectangle whose aspect ratio is 3.2 (=34.4/10.6).

In this embodiment, the ejection orifice 100 is arranged with respect to the heat generating element 401 with the center of the ejection orifice 100 deviated from the center of the heat generating element 100 in an ink flowing direction (a direction from the common liquid chamber 112 to the ejection orifice 100) when viewed from a direction to which an ink is ejected from the ejection orifice. The length $Ln_1$ on a downstream side (on the side of the ejection orifice 100) from the center of the heat generating element 401 of the flow path 300 is 22.5 μm, and the length $Ln_2$ on an upstream side thereof is 39.6 μm.

In this embodiment, a plurality of nozzle filters 102 that are columnar members each corresponding to a position between the flow paths 300 is provided in the common liquid chamber 112. The diameter c of the nozzle filter 102 is 13 μm. The distance $Ln_f$ between the center of the heat generating element 401 and the nozzle filter 102 is 57.0 μm.

The distance a between a center of the ink supply port 500 and an end portion communicating with the common liquid chamber 112 is 56 μm. The distance b between the center of the ink supply port 500 and the center of the heat generating element 401 is 137.5 μm. A distance d between the center of the heat generating element 401 and the center of the ejection orifice 100, i.e., a positional deviation d between the center of the heat generating element 401 and the center of the ejection orifice 100, is 12 μm. This positional deviation d is set in such a manner that the ejection orifice 100 is present over an end portion of the heat generating element 401 on the downstream side (ejection orifice side) in the ink flowing direction.

In the present invention, such an arrangement inhibits the heat generating element 401 from causing cavitation at an upper surface thereof and from being damaged attending on the cavitation even when the heat generating element is in a slender form whose aspect ratio exceeds 3. The principle thereof will hereinafter be described.

FIGS. 3A to 3I are views for explaining a liquid ejection method in this embodiment in time series and are sectional views taken along line 3-3 in FIG. 2.

Figure 3A:
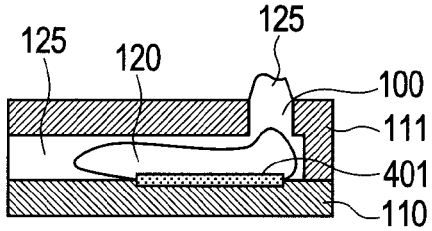
FIGS. 3A, 3B, 3C, 3D, 3E, 3F, 3G, 3H and 3I are sectional views illustrating a liquid ejection method in the first embodiment of the present invention in order.
Figure 3B:
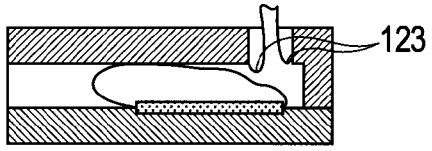

The heat generating element 401 is first driven through a wiring and an electrode that are not illustrated. An ink (a liquid to be ejected) 125 is heated by heat generated by the heat generating element 401 to generate a bubble. As illustrated in FIG. 3A, a bubble 120 generated by the heating grows, and a part of the ink 125 is projected from the ejection orifice 100 by a bubbling pressure (omitting an illustration of a tip portion of the ink 125). After the volume of the bubble 120 increases once as described above to reach a maximum volume, the bubble 120 contracts as illustrated in FIG. 3B, and a meniscus 123 of the ink located in the ejection orifice 100 recedes attending thereon.

Figure 3C:
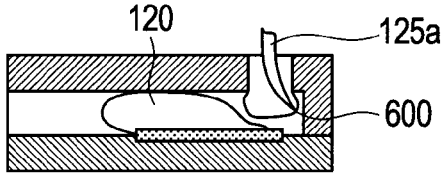

In this embodiment, the center of the heat generating element 401 is located on the upstream side in the ink flowing direction with respect to the center (center of gravity) of the ejection orifice 100. Accordingly, the meniscus 123 unequally recedes in the process of the contraction of the bubble 120 so as to become larger on a side (upstream side) near to the bubble 120 on the surface of the heat generating element 401 and become smaller on a side (downstream side) distant from the bubble 120 as illustrated in FIGS. 3B and 3C. As a result, a tail end portion (tail) of a droplet 125*a* to be ejected bends in a direction of getting far away from the bubble 120 on the surface of the heat generating element 401 as illustrated in FIG. 3C. A motion component perpendicular to a droplet-ejecting direction (a direction perpendicular to the heat generating element 401 and the ejection orifice 100) is applied to this tail of the droplet to be ejected. Accordingly, a cut point 600 where the tail of the droplet 125*a* to be ejected is separated from the ink remaining in the flow path is such a position as to be deviated toward a side distant from the bubble 120 on the surface of the heat generating element 401 as illustrated in FIG. 3C. The droplet 125*a* to be ejected that has been separated at the tail thereof is then ejected toward a recording medium (not illustrated) located on the outside. At this time, minute mist generated upon the separation of the droplet 125*a* to be ejected at the tail thereof receives a motion component perpendicular to the droplet-ejecting direction like the bent tail of the droplet 125*a* to be ejected in the interior of the flow path 300. The mist that has received such a motion component impacts on an inner wall of the flow path 300 and is thus inhibited from flying off toward the outside from the ejection orifice 100.

Figure 3D:
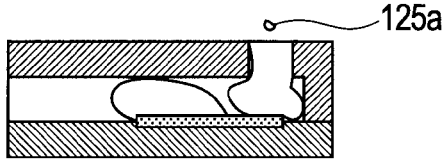
Figure 3E:
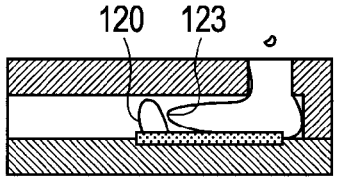
Figure 3F:
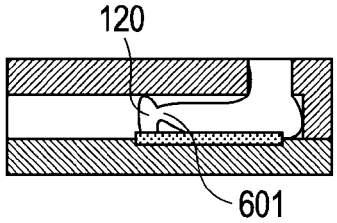

In this embodiment, the ejection orifice 100 is arranged with respect to the heat generating element 401 deviated toward the downstream side in the ink flowing direction, so that the bubble 120 is inhibited from being divided in the vicinity of the ejection orifice 100. In short, the bubble 120 on the surface of the heat generating element 401 is not divided, but successively collapses from the neighborhood of the ejection orifice 100 toward the side of the common liquid chamber 112 as illustrated in FIGS. 3B and 3C. Thereafter, the meniscus 123 further recedes toward the side of the common liquid chamber 300 as illustrated in FIGS. 3D and 3E, and the bubble 120 on the surface of the heat generating element 401 contracts. The meniscus 123 reaches the bubble 120 before the bubble 120 disappears, i.e., during the contraction of the bubble 120, as illustrated in FIG. 3F, and the meniscus 123 and the bubble 120 link to each other at a bubble communicating point 601. As a result, the bubble is opened to the air, and an internal pressure of the bubble conforms to the atmospheric pressure.

In the present invention, the ejection orifice 100 and the heat generating element 401 are arranged with deviated positional relation in such a manner that the ejection orifice 100 overlaps with the heat generating element 401 when planarly viewed (from a direction to which the ink is ejected from the ejection orifice), i.e., a part on the upstream side of the ejection orifice 100 overlaps with an end portion on the downstream side of the heat generating element 401. The bubble communicating point 601 is thereby produced in a vicinity of an end portion on the upstream side of the heat generating element 401, i.e., at a position distant from the ejection orifice 100 within the flow path 300. The meniscus 123 reaches this bubble communicating point 601 after the droplet 125*a* to be ejected separates from the ink 125 remaining in the flow path 300. Accordingly, the bubble 120 communicates with the air, and the internal pressure of the bubble conforms to the atmospheric pressure after the droplet 125*a* to be ejected separates from the ink 125 remaining in the flow path 300. A phenomenon that the bubble communicates with the outside air (the air) is generally disturbed at every event of ejection, and the scattering becomes great. Therefore, if the meniscus 123 communicates with the bubble before the droplet 125*a* to be ejected separates from the ink 125 remaining in the flow path 300, the tail of the droplet 125*a* to be ejected is affected by the scattering when the bubble communicates with the air, resulting in tailing disturbance at every event. As described above, according to the construction of the present invention, the tailing disorder of the droplet 125*a* to be ejected is inhibited compared with the case where the bubble 120 communicates with the air and the internal pressure of the bubble 120 conforms to the atmospheric pressure before the droplet 125*a* to be ejected separates from the ink 125 remaining in the flow path 300 or at a timing close thereto. As a result, the amount of the mist generated upon the separation of the tail of the droplet 125*a* to be ejected from the ink 125 remaining in the flow path 300 is extremely reduced. In addition, a generation position of minute mist possibly generated when the bubble 120 communicates with the air at the bubble communicating point 601 is located on the upstream side with respect to the center (center of gravity) of the heater distant from the ejection orifice 100 within the flow path 300, so that a possibility that the minute mist may fly off to the outside from the ejection orifice 100 is extremely low.

Figure 3G:
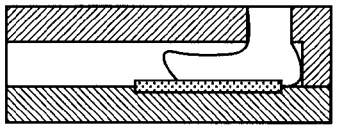
Figure 3H:
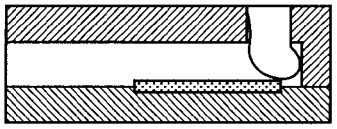
Figure 3I:
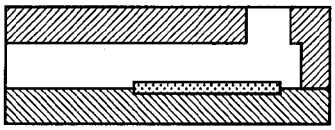
Figures 4A, 4B, 4C, 4D, 4E, 4F, 4G, 4H, 4I:
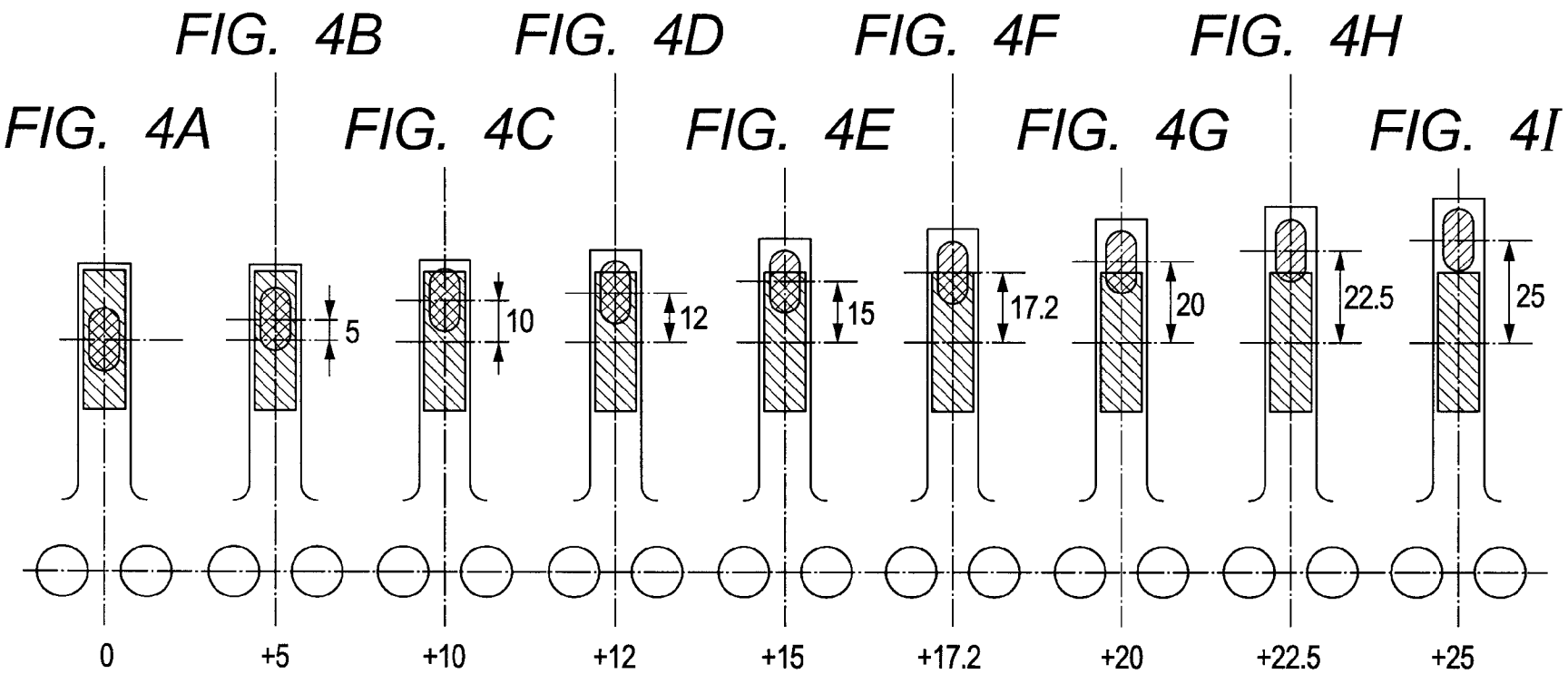
FIGS. 4A, 4B, 4C, 4D, 4E, 4F, 4G, 4H and 4I are plan views illustrating principal parts of liquid ejection heads with their positional deviations respectively varied for experiment.

After the meniscus 123 links to the bubble 120 at the bubble communicating point 601, the flow path 300 is refilled with the ink 125 from the common liquid chamber 112 by capillary force to generate a meniscus 123 again as illustrated in FIGS. 3G to 3I.

In order to realize such a liquid ejection method, the positional deviation d (FIG. 2) between the center of the heat generating element 401 and the center of the ejection orifice 100 is an important parameter. The present inventor conducted an experiment for confirming the influence of this positional deviation d on the liquid ejection method. The details of this experiment will be described with reference to FIGS. 4 to 6. FIGS. 4A to 4I are top views respectively illustrating flow paths 300 of plural prototypes of the liquid ejection head 101 with their positional deviations d respectively varied. As illustrated in FIGS. 4A to 4I, the positional deviations d of these liquid ejection heads 101 range from 0 μm to 25 μm.

When the positional deviation falls within a range of from 10 μm to 22.5 μm (FIGS. 4C to 4H), the ejection orifice 100 overlaps with an end portion on an downstream side of the heat generating element 401 when viewed from a direction to which an ink is ejected. Upon ejection of a liquid from the liquid ejection heads 101 respectively having the structures illustrated in FIGS. 4A to 4I, whether cavitation occurred or not on the upstream side within the flow path 300, whether cavitation occurred or not on the downstream side, and whether the heat generating element 401 was damaged or not in an ejection durability test were confirmed. The results thereof are shown in Table 1. Incidentally, the positional deviation d is the distance from the center (center of gravity) of the ejection orifice 100 to the center (center of gravity) of the heat generating element 401 on the downstream side. The unit of the positional deviation is μm though it is omitted in FIGS. 4A to 4F. In Table 1, the degree of prevention of occurrence of cavitation and the durability (the degree of prevention of damage) of the heat generating element 401 are respectively indicated by 3 ranks of AA: good (with a margin); A: good; and C bad (damaged).

TABLE 1

| | Positional deviation d [μm] | | | | | | | | |
|---|---|---|---|---|---|---|---|---|---|
| | 0 | +5 | +10 | +12 | +15 | +17.2 | +20 | +22.5 | +25 |
| Cavitation on downstream side | C | C | A | AA | AA | AA | AA | AA | AA |
| Cavitation on upstream side | AA | AA | AA | AA | AA | A | C | C | C |
| Durability | C | C | A | AA | AA | A | C | C | C |

As apparent from Table 1, cavitation occurred on the downstream side of the heat generating element 401 when the positional deviation d was 5 μm or less, wherein the whole of the ejection orifice 100 was completely superimposed on the heat generating element 401, and the end portion on the downstream side of the heat generating element 401 was located on the outside of the ejection orifice 100. As a result, the heat generating element 401 was damaged, and the durability thereof was deteriorated. On the other hand, no cavitation occurred on the downstream side when the positional deviation d was 10 μm or more. This is attributable to the above-mentioned condition that the bubble 120 is not divided in the vicinity of the ejection orifice 100, but successively collapses from the neighborhood of the ejection orifice 100 toward the side of the common liquid chamber 112 (see FIGS. 3B to 3E).

On one hand, cavitation occurred on the upstream side of the heat generating element 401 when the positional deviation d was 20 μm or more, wherein the center of the ejection orifice 100 was greatly separated from the center of the heat generating element 401. As a result, the heat generating element 401 was damaged, and the durability thereof was deteriorated. This is attributable to the condition that the bubble 120 disappears before the receded meniscus 123 reaches the bubble 120 as illustrated in FIG. 3F, i.e., the bubble 120 links to the meniscus 123, because the ejection orifice 100 is too distant from the center of the heat generating element 401, so that cavitation occurs. On the other hand, no cavitation occurred on the upstream side when the positional deviation d was 17.2 μm, wherein the center of the ejection orifice 100 conforms to an end portion of the heat generating element 401, and when the positional deviation d was less than 17.2 μm.

Figure 5A:
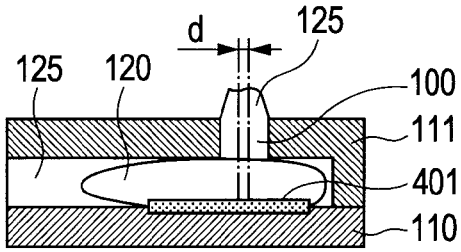
FIGS. 5A, 5B, 5C, 5D, 5E, 5F, 5G and 5H are sectional views illustrating a liquid ejection method of a liquid ejection head of a comparative example of the present invention in order.
Figure 5B:
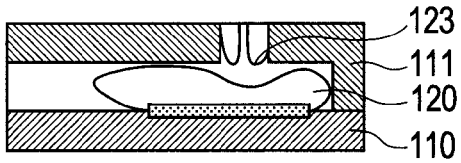
Figure 5C:
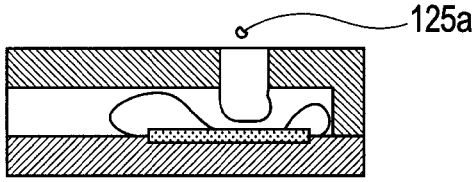
Figure 5D:
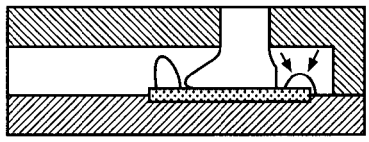
Figure 5E:
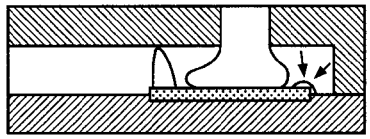
Figure 5F:
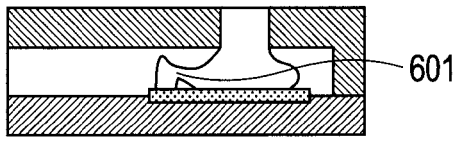
Figure 5G:
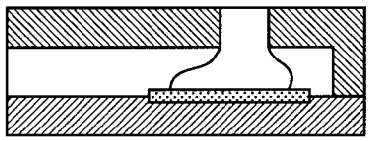
Figure 5H:
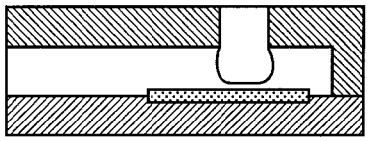
Figure 6A:
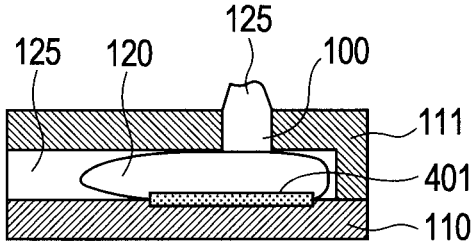
FIGS. 6A, 6B, 6C, 6D, 6E, 6F, 6G and 6H are sectional views illustrating a liquid ejection method of a liquid ejection head of a comparative example of the present invention in order.
Figure 6B:
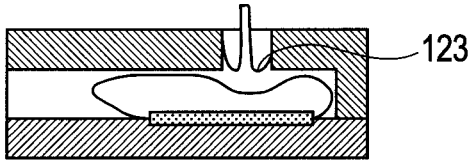
Figure 6C:
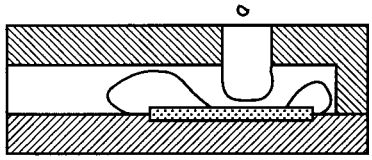
Figure 6D:
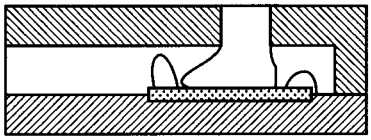
Figure 6E:
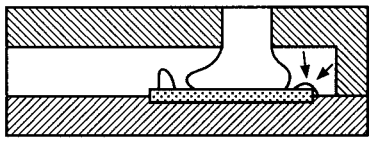
Figure 6F:
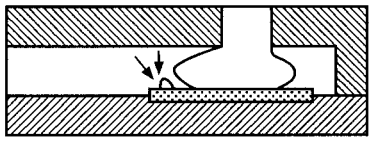
Figure 6G:
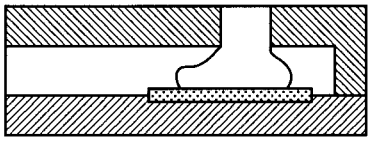
Figure 6H:
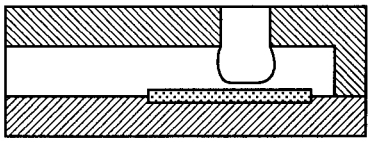

Such a phenomenon will be described in more detail. A typical liquid ejection condition when the center of the ejection orifice 100 conforms or approaches to the center of the heat generating element 401 (when the positional deviation d is 0 μm or more and less than 10 μm) is illustrated in FIGS. 5A to 5H. In this case, the bubble 120 is divided on the surface of the heat generating element 401 when the bubble 120 grows, and the droplet 125*a* to be ejected is ejected to the outside from the ejection orifice 100 as illustrated in FIGS. 5A to 5C. One piece of the divided bubble 120 (a bubble on the upstream side) may possibly link to the receded meniscus. However, the other piece of the divided bubble 120 (a bubble on the downstream side) disappears without linking to the receded meniscus 123 to exert damage caused by cavitation on the heat generating element 401 (see FIGS. 5D to 5F).

Figure 7A:
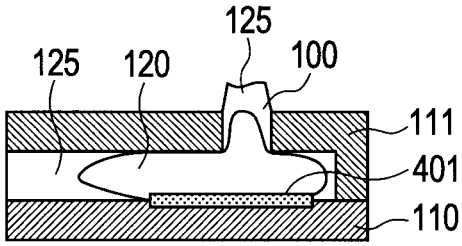
FIGS. 7A, 7B, 7C, 7D and 7E are sectional views illustrating a liquid ejection method of a liquid ejection head of a comparative example of the present invention in order.
Figure 7B:
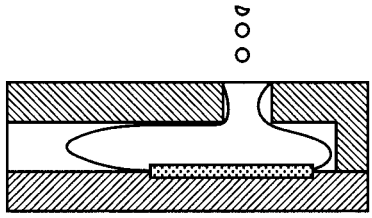
Figure 7C:
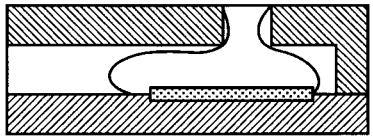
Figure 7D:
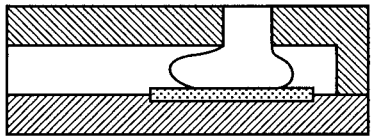
Figure 7E:
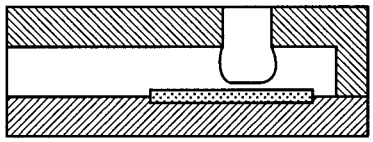

The case where the electric energy applied to the heat generating element 401 was reduced in such a flow path 300 is illustrated in FIGS. 6A to 6H. In this case, both pieces of the bubble 120 divided on the surface of the heat generating element 401 disappear without linking to the receded meniscus 123 to exert damage caused by cavitation on the heat generating element 401 (see FIGS. 6D to 6F). The case where the electric energy applied to the heat generating element 401 was increased to the contrary is illustrated in FIGS. 7A to 7E. In this case, the bubble 120 links to the meniscus 123 through the ejection orifice 100 to communicate with the outside air. In such a state, the damage caused by cavitation does not occur on the heat generating element 401. However, a tail of the droplet 125*a* to be ejected is torn in pieces as illustrated in FIG. 7B to generate many satellites or mists in addition to a main droplet, so that print quality is lowered, and moreover environmental mist pollution occurs. As described above, it is difficult to achieve the prevention of damage caused by cavitation and the prevention of generation of mist at the same time by adjusting the electric energy applied to the heat generating element 401.

Thus, in the present invention, the positional deviation d between the center of the ejection orifice 100 and the center of the heat generating element 401 is suitably selected, thereby achieving the prevention of damage caused by cavitation and the prevention of generation of mist at the same time.

As shown in Table 1, the liquid ejection head 101 whose positional deviation d between the center of the ejection orifice 100 and the center of the heat generating element 401 was 10 μm or more and 17.2 μm or less was good in durability. This results from the condition that the ejection orifice 100 overlaps with the heat generating element 401 when viewed from an ejecting direction, and the end portion on the downstream side of the heat generating element 401 is located on the inside of the ejection orifice 100, whereby the bubble is prevented from being divided on the downstream side. In addition, the center of the ejection orifice 100 is located in the inside of the heat generating element 401, the ejection orifice 100 is not so distant from the heat generating element 401, the receded meniscus 123 can reach the contracted bubble 120 and link thereto, and the internal pressure of the bubble 120 conforms to the atmospheric pressure, thereby indicating that the cause of cavitation is not formed. It was confirmed that when the positional deviation d between the center of the ejection orifice 100 and the center of the heat generating element 401 was 10 μm or more and 17.2 μm or less, cavitation does not occur on both upstream side and downstream side, and a problem of disconnection in the heat generating element 401 is not caused.

Figure 8:
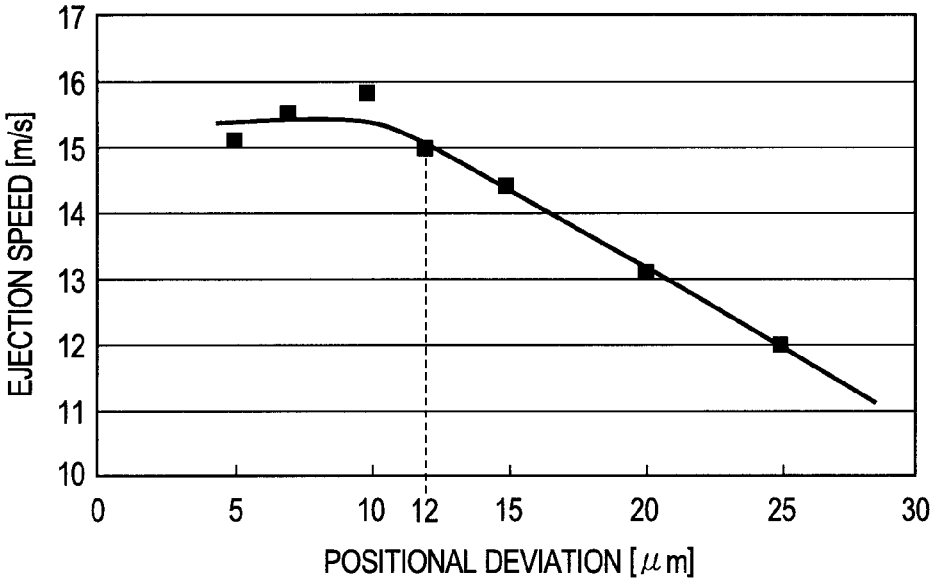
FIG. 8 diagrammatically illustrates the relationship between positional deviation and ejection speed in the liquid ejection method in the first embodiment of the present invention.

Incidentally, the flow path resistance between the heat generating element 401 and the ejection orifice 100 becomes great as the positional deviation d between the center of the ejection orifice 100 and the center of the heat generating element 401 increases, so that the energy efficiency is lowered to lower the ejection speed of the droplet as illustrated in FIG. 8. Therefore, the construction causing no damage caused by cavitation as described above while inhibiting the lowering of the energy efficiency is favorable. Taking the experimental results shown in Table 1 and FIG. 8 into consideration, the case where the positional deviation d between the center of the ejection orifice 100 and the center of the heat generating element 401 is 12 μm is particularly favorable.

Figure 9A:
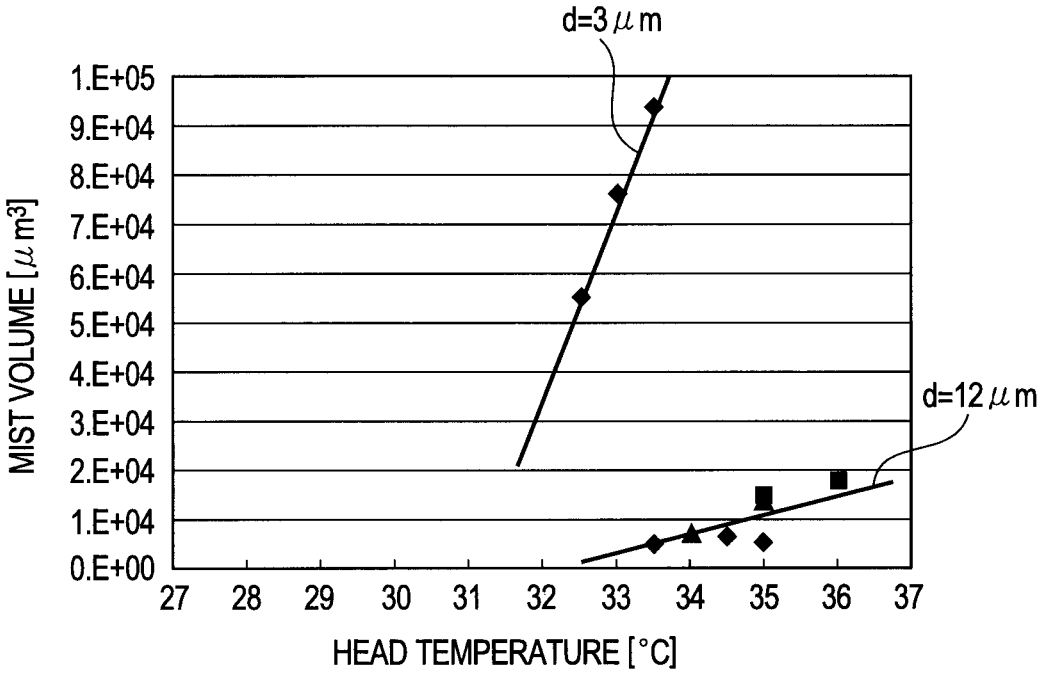
FIG. 9A diagrammatically illustrates the relationship between the temperature of a liquid ejection head and the volume of mist, and FIG. 9B diagrammatically illustrates the relationship between the ejection amount of a droplet and the volume of mist.

A liquid ejection experiment was conducted on a liquid ejection head 101 of this favorable construction (positional deviation d: 12 μm) and a liquid ejection head 101 whose positional deviation d is 3 μm. Specifically, the volume of mist suspended around the flow path 300 when a liquid was ejected while varying the temperature of each liquid ejection head 101 was measured. The results are illustrated in FIG. 9A. In addition, the volume of mist suspended around the flow path 300 when a liquid was ejected while varying bubbling energy to vary an ejection amount of a droplet was measured. The results are illustrated in FIG. 9B.

Figure 9B:
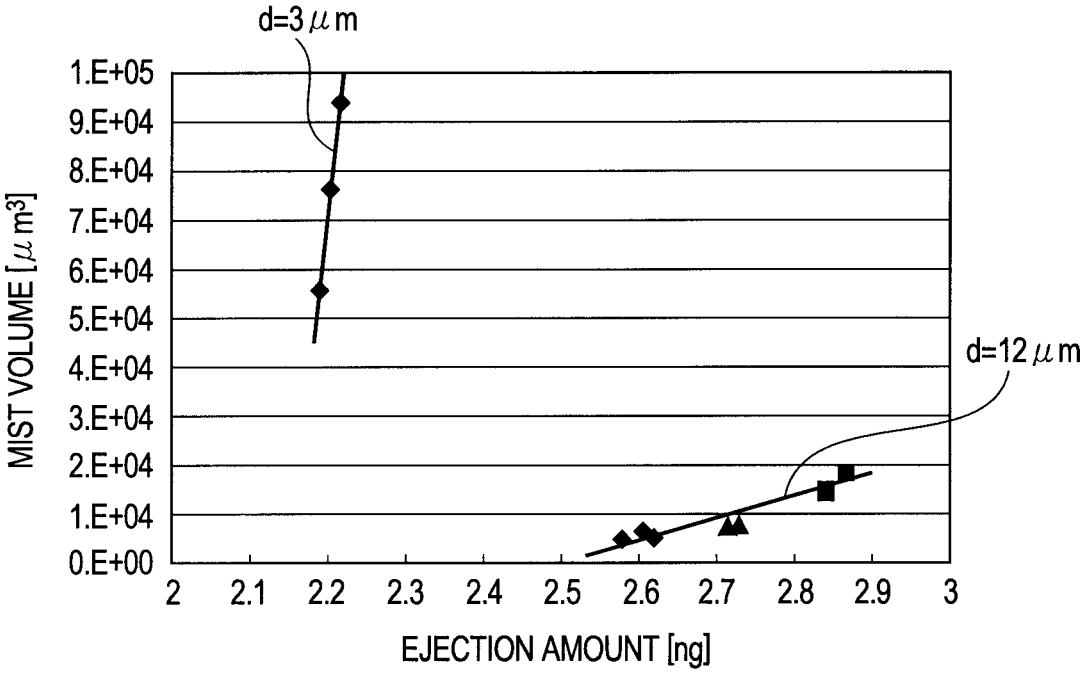

As illustrated in FIGS. 9A and 9B, in both liquid ejection heads 101 as tested, there is a tendency for the mist to increase as the temperature of the liquid ejection head 101 becomes high, and as the ejection amount of the liquid increases. However, the amount (volume) of the mist generated is much smaller in the liquid ejection head 101 whose positional deviation d is 12 μm than in the liquid ejection head 101 whose positional deviation d is 3 μm. This is attributable to the condition that when a suitable positional deviation d is set, the meniscus 123 is unequally formed, the tail of the droplet 125*a* to be ejected is curvedly formed, and the mist generated upon the separation of the droplet also receives a motion component in the same direction as that upon the curving of the tail of the droplet 125*a* to be ejected. The mist that has received such a motion component impacts on an inner wall of the flow path 300 without heading toward the ejection orifice 100, so that the mist does not fly off toward the outside from the ejection orifice 100. In addition, the bubble communicating point 601 where the receded meniscus 123 links to the contracted bubble 125 is produced at a position distant from the ejection orifice 100 within the flow path 300. Accordingly, after the droplet 125*a* to be ejected separates from the ink 125 remaining in the flow path 300, the meniscus 123 links to the bubble 120, and the internal pressure of the bubble conforms to the atmospheric pressure. As a result, the tailed state of the droplet 125*a* to be ejected is hard to be disturbed. In addition, even when mist is generated at the bubble communicating point 601, a possibility that the mist may fly off to the outside from the ejection orifice 100 is low because the position of the generation is a position distant from the ejection orifice 100 within the flow path 300.

As described above, according to the present invention, the prevention of damage caused by cavitation to the liquid ejection head and the inhibition of mist or satellite can be achieved at the same time. Even when a heat generating element 401 is formed in a slender form whose aspect ratio is 2.5 or more for ejecting a droplet of 1.5 pl or more, such effects can be achieved, and so such a liquid ejection head is very effective.

Second Embodiment

The second embodiment of the present invention is described with reference to FIGS. 10A and 10B.

In the first embodiment described above, the ejection orifices 100 and the heat generating elements 401 which are located in respective rows on both sides of the common liquid chamber 112 are arranged side by side on a straight line. On the other hand, in the second embodiment, the ejection orifices 100 and the heat generating elements 401 in each row are arranged in a zigzag form. In addition, the ejection orifice 100 is circular, and the ejection orifice 100 on a side of the flow path with a relatively long length is formed in a tapered form that becomes narrower toward the outside. Other constructions are the same as in the first embodiment.

In this embodiment, the ejection orifices 100 are arranged in a zigzag form, so that long flow paths 300 and short flow paths 300 are present mixedly. From the viewpoint of recording quality, the liquid ejection head is set in such a manner that a droplet of 1 ng is ejected through the long flow path 300, and a droplet of 2 ng is ejected through the short flow path 300. A tapered ejection orifice 100 is provided in the long flow path 300 through which the ejection amount is 1 ng for improving the efficiency of ejection.

Figure 10A:
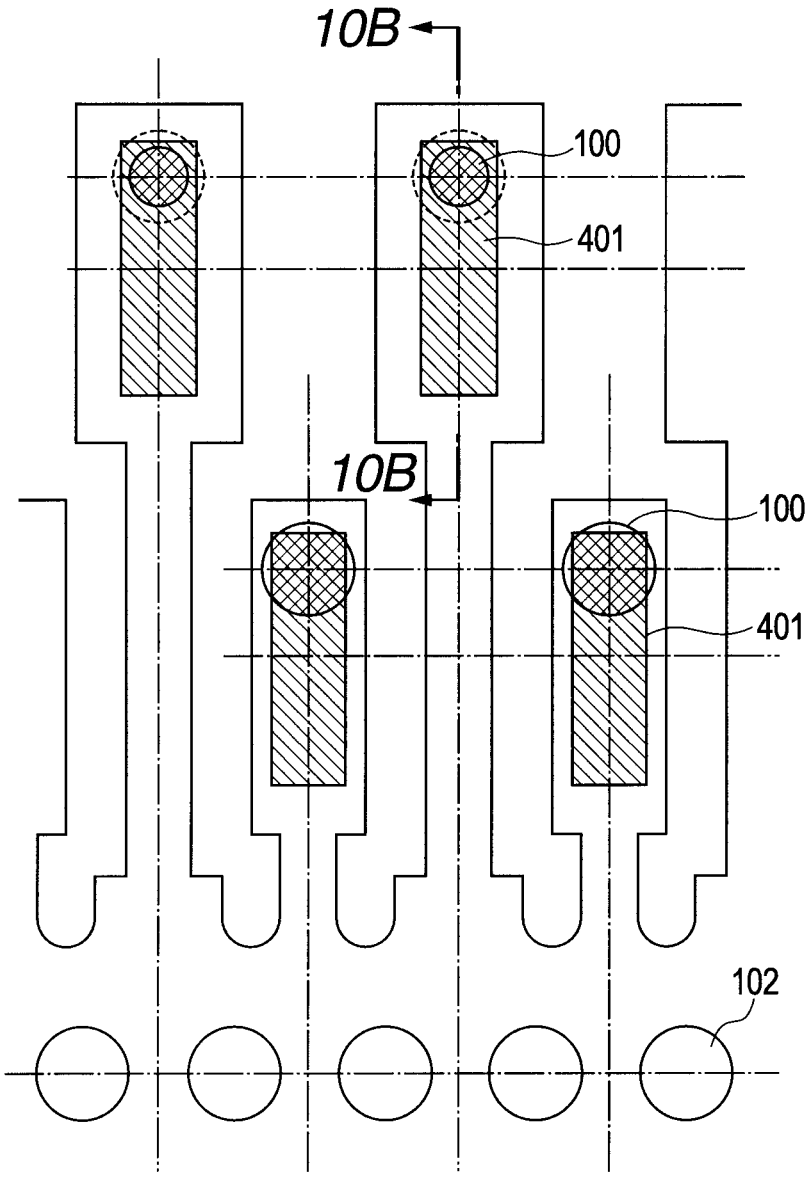
FIG. 10A is an enlarged plan view of a principal part of a liquid ejection head according to a second embodiment of the present invention, and 10B is a sectional view taken along line 10B-10B in FIG. 10A.
Figure 10B:
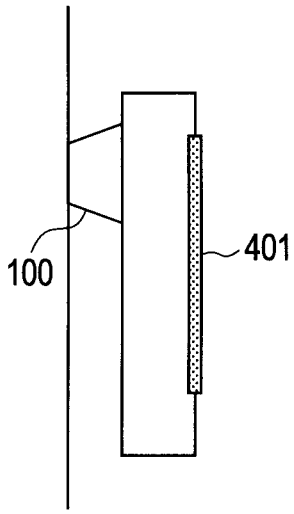

FIG. 10B is a sectional view taken along line 10B-10B in FIG. 10A that is a plan view. Suitably setting the positional deviation d between the center of the ejection orifice 100 and the center of the heat generating element 401 is effective even when the ejection orifices 100 are arranged in the zigzag form and the length of the flow path 300 is fixed, in particular, when the aspect ratio of the heat generating element is large. Incidentally, when the ejection orifice 100 is tapered, it is effective from the viewpoint of preventing division of the bubble on the downstream side to arrange the ejection orifice 100 in such a manner that the diameter of a large-diameter portion (an opening on the side of the heat generating element of the ejection orifice) of the ejection orifice 100 intersects with the end portion on the downstream side of the heat generating element 401.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-026104, filed Feb. 9, 2011, which is hereby incorporated by reference herein in its entirety.

What is claimed is:

1. A method of ejecting liquid from a liquid ejection head, comprising:

providing a liquid ejection head comprising an ejection orifice for ejecting a liquid, a flow path for supplying the liquid from a liquid supply port holding the liquid to the ejection orifice, and a heat generating element of a rectangular form with a long-side to short-side ratio of 2.5 or more for generating thermal energy used to eject the liquid, a longitudinal direction of the heat generating element being arranged along an extending direction of the flow path; and driving the heat generating element to generate a bubble in the liquid, and allowing a meniscus of the liquid entered in the interior of the flow path from the ejection orifice during contraction of the bubble after the bubble has enlarged to communicate with the bubble on an upstream side, with respect to a liquid flowing direction within the flow path, of a longitudinal center of the heat generating element, the longitudinal center being defined with respect to the longitudinal direction, thereby allowing the bubble to communicate with outside air.

2. The liquid ejection method according to claim 1, wherein a center of the ejection orifice overlaps with the heat generating element when viewed from a direction in which the liquid is ejected from the ejection orifice.

3. The liquid ejection method according to claim 1, wherein an end portion of the heat generating element on a downstream side with respect to the liquid flowing direction within the flow path, when viewed from the direction in which the liquid is ejected from the ejection orifice, is located between an end portion of the ejection orifice on the downstream side and an end portion of the ejection orifice on the upstream side when viewed from the direction in which the liquid is ejected from the ejection orifice.

4. The liquid ejection method according to claim 1, wherein the bubble communicates with the outside air after a tail end portion of a droplet projected from the ejection orifice to the outside separates from the liquid remaining in the interior of the flow path.

* * * * *